United States Patent [19]

Chinman

[11] Patent Number: 4,562,952

[45] Date of Patent: Jan. 7, 1986

[54] WRAPPER FOR CLOTHING

[76] Inventor: Carole Chinman, c/o Connolly and Hutz, 1220 Market St., P.O. Box 2207, Wilmington, Del. 19899-2207

[21] Appl. No.: 655,587

[22] Filed: Sep. 28, 1984

[51] Int. Cl.[4] ..... B65D 65/10; B65D 85/18

[52] U.S. Cl. ..... 229/87 A; 53/429; 53/474; 150/52 R; 206/292

[58] Field of Search ..... 229/87 R, 87 S, 87 A; 150/52 R; 206/280, 466, 471, 278, 281, 292, 293, 299; 383/4, 39, 119; 53/429, 474, 156

[56] References Cited

U.S. PATENT DOCUMENTS

| | | | |
|---|---|---|---|
| 222,614 | 12/1879 | Weaver | 229/87 R |
| 258,844 | 5/1882 | Young . | |
| 485,509 | 11/1892 | Speed . | |
| 862,154 | 8/1907 | Greenawalt | 229/87 A |
| 885,721 | 4/1908 | Cave . | |
| 1,114,913 | 10/1914 | Riles | 383/39 |
| 1,134,285 | 4/1915 | Page | 229/87 R |
| 1,215,868 | 2/1917 | Rosenfeld | 229/87 A |
| 1,385,695 | 7/1921 | MacCormack | 150/52 R |
| 1,474,826 | 11/1923 | Hudec . | |
| 1,604,090 | 10/1926 | Wolfson . | |
| 1,668,572 | 5/1928 | Parmele | 206/45.14 |
| 2,175,387 | 10/1939 | Goding | 229/87 A X |
| 2,226,231 | 12/1940 | Morse | 53/429 X |
| 2,269,915 | 1/1942 | Porter . | |
| 2,443,702 | 6/1948 | Bruning | 206/466 |
| 2,521,529 | 9/1950 | Manney | 53/429 |
| 2,632,564 | 3/1953 | Bloom | 206/281 |
| 2,745,544 | 5/1956 | Folk | 206/45.33 |
| 3,024,824 | 3/1962 | Bass | 150/52 R |
| 3,085,725 | 4/1963 | Caparosa | 206/292 X |
| 3,511,364 | 5/1970 | Airdo | 53/429 X |
| 3,623,526 | 11/1971 | Robertson | 150/52 R |
| 3,886,712 | 6/1975 | Sylvester | 53/429 |
| 4,106,260 | 8/1978 | King | 53/429 |
| 4,139,095 | 2/1979 | Weaver | 206/278 |

FOREIGN PATENT DOCUMENTS

| | | | |
|---|---|---|---|
| 1507294 | 11/1967 | France | 206/281 |
| 331129 | 7/1930 | United Kingdom . | |
| 1596366 | 8/1981 | United Kingdom | 206/280 |

*Primary Examiner*—Allan N. Shoap
*Assistant Examiner*—Bryon Gehman
*Attorney, Agent, or Firm*—Connolly and Hutz

[57] ABSTRACT

A wrapper for clothing and the like includes a flexible member having a central area with a plurality of outwardly extending wing sections. A reinforcing base is provided in the central area. The wrapper also includes a shape retainer having the same geometric shape as the reinforcing member but being of a lesser dimension. Accordingly, articles of clothing may be folded around the shape retainer so that the articles are folded into the geometric shape, and the articles may then be placed on top of the base. The wing sections may then be folded over the articles to wrap the articles therein.

37 Claims, 7 Drawing Figures

WRAPPER FOR CLOTHING

BACKGROUND OF THE INVENTION

One of the hazards of traveling involves the packing of articles of clothing and the like. In particular clothing frequently becomes wrinkled because of shifting and moving, and it is necessary that the articles be unpacked as soon as possible to minimize wrinkling. Additionally present techniques used for packing clothing do not lend themselves to packing in an organized manner whereby it is readily apparent where various types of articles have been packed. Ideally, the articles should be packed in such a manner that they wil not wrinkle so that they can be left packed particularly where a trip involves moving from one location to another so as to eliminate the need for packing and unpacking at each location. Desirably a packing technique should permit the articles to be packed in such an organized fashion that the user may readily selectively remove specific articles without unpacking others. Such wrapping techniques should even permit the articles to be stored in a wrapped condition for an indefinite period of time even when the traveler is home.

SUMMARY OF INVENTION

An object of this invention is to provide a wrapper for clothing and the like which fulfills the above needs and desires for an optimum wrapper.

A further object of this invention is to provide such a wrapper which is convenient to use and pleasing in appearance.

In accordance with this invention, the wrapper is made of a flexible member having a central area and a plurality of outwardly extending wing sections. A base is provided in the central area to provide some degree of rigidity thereto. The wrapper further includes a shape retainer having the same geometric configuration as the base but is of a lesser dimension. In practice an article of clothing would be folded about the shape retainer so as to assume the geometric shape. The shape retainer would then be removed, and the folded article would be placed on top of the base. This process would be repeated for the desired number of articles. The shape retainer itself could be placed upon the uppermost article. The wing sections would then be folded over each other and fastened together to provide the finished wrapper.

Various ancillary features of this invention include the provision of a pocket in the central area so that the base could be easily inserted into and removed from the pocket. Accordingly the main portion of the wrapper could be made of a fabric material which could be easily cleaned. Where desired, such as if the base were damaged, a new base could be readily inserted into the pocket. Additionally the wrapper could include an external loop at one of the fold lines. The loop would provide a means for identifying the types of articles within the wrapper and also function as a means for hanging the wrapper.

THE DRAWINGS

DETAILED DESCRIPTION

Figure 1:
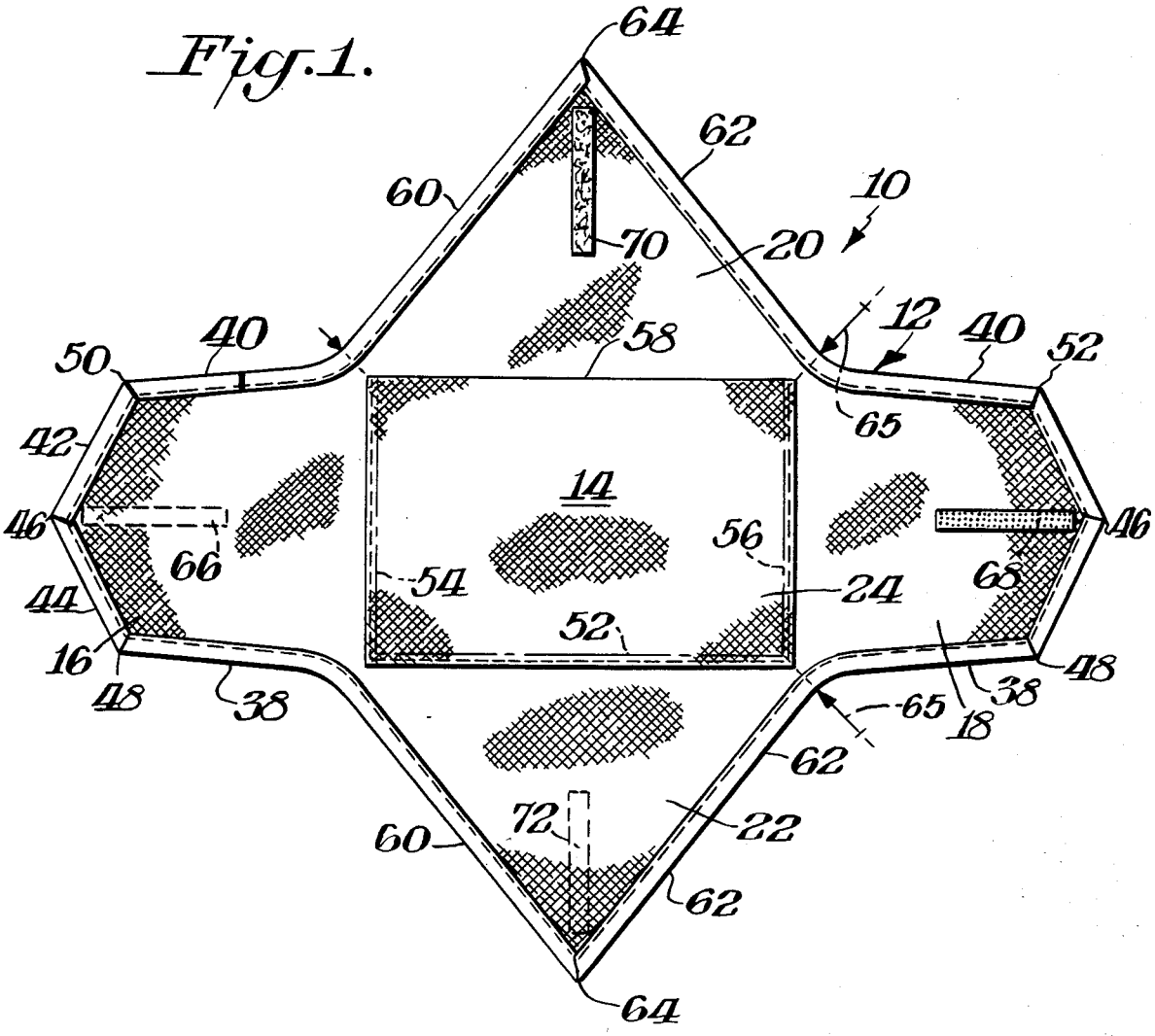
FIG. 1 is a top plan view of a flexible member used for a wrapper in accordance with this invention.
Figure 5:
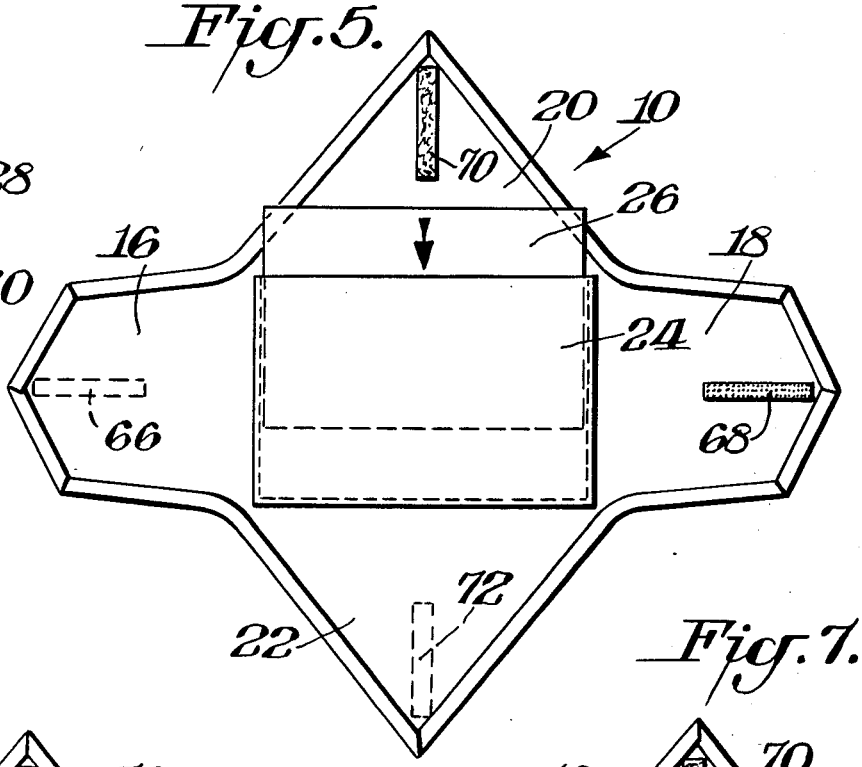
FIG. 5 is a top plan view similar to FIG. 1 of a flexible member and showing a base being inserted therein.

FIG. 1 illustrates a wrapper 10 which includes a flexible member 12 having a central area 14 and a plurality of wing sections. The wing sections specifically comprise inner flaps 16, 18 and outer flaps 20, 22. A fabric member is stitched along three sides to the central area to form a pocket 24 which is open along one edge as best shown in FIG. 5.

The pocket 24 is of a particular geometric configuration preferably a rectangle. It is to be understood that the term rectangle is used in its broadest sense and includes a square where opposite sides are parallel and joining angles are right angles. A rectangle provides the most convenient geometric shape with regard to most articles of clothing. Within the broad concepts of this invention, however, other geometric shapes such as circles or elipses may be used without departing from the spirit of this invention, although such other shapes would not provide as smooth and compact a wrapper as with a rectangular shape.

In accordance with this invention, means are provided at central area 14 to rigidify central area 14. The means preferably includes a base 26 (FIG. 5) of a size and shape to snugly fit within the pocket 24. As shown in FIG. 5, base 26 is slid into pocket 24 through the open edge thereof. The wrapper 10 further includes a shape retainer 28 shown in FIG. 2. As illustrated, shape retainer 28 is of the same geometric configuration as base 26.

Figure 4:
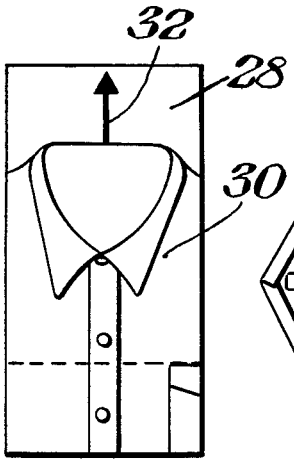
FIG. 4 is a top plan view showing the folding of an article of clothing about the shape retainer of FIG. 2.

In practice, as shown in FIG. 4, articles of clothing such as a shirt 30 would be folded around shape retainer 28 so that the shirt 30 then assumes the same shape as shape retainer 28 but would be of larger dimension in accordance with the thickness of the material of shirt 30. The relative size difference between shape retainer 28 and base 26 would be such that the folded shirt 30 would be about the same size as base 26 after being folded around shape retainer 28.

Figure 2:
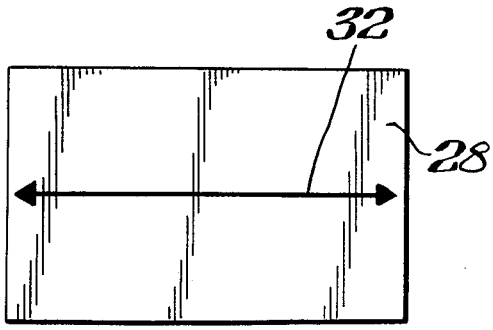
FIG. 2 is a top plan view of a shape retainer used with the wrapper of FIG. 1.

As shown in FIG. 2, indicia such as a line 32 is provided on shape retainer 28 along the longitudinal center line to provide a guide for centering the article of clothing when the article is being folded around shape retainer 28. Thus, for example, the center of a collar on shirt 30 could be positioned at the indicia line 32.

Figure 3:
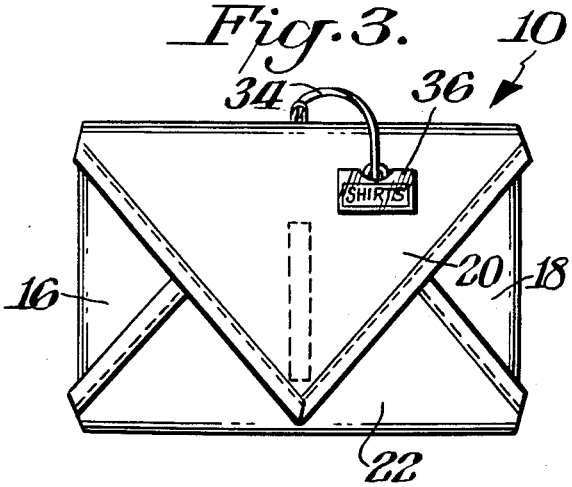
FIG. 3 is a side elevation view of a wrapper in accordance with this invention in its folded or wrapped condition.
Figure 6:
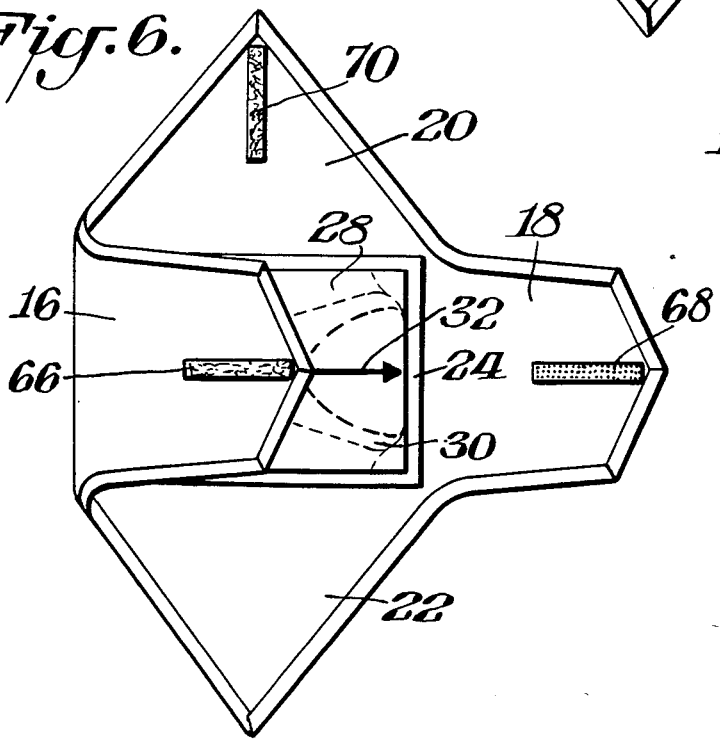
FIG. 6 is a top plan view similar to FIG. 5 showing one step in the folding of the wrapper.

After an article of clothing has been folded around shape retainer 28, the shape retainer 28 is then removed from the article of clothing by sliding it outwardly in a direction, for example, away from the collar of shirt 30. The same procedure would then be performed for each article of clothing wherein the article is folded about shape retainer 28, then shape retainer 28 is removed from the article and then the article is placed on base 26 until a stack of articles is in the central area. After a sufficient stack of articles has been folded and placed in central area 14, shape retainer 28 is then placed on top of the stack as shown in FIG. 6. Inner flaps 16 and 18 are then folded on top of each other. Outer flaps 20 and 22 are then folded on top of inner flaps 16, 18. The flaps are fastened together to provide the finished wrapper which is shown in FIG. 3.

In accordance with one feature of this invention, a loop 34, preferably made of a fabric material, is integrally connected to flexible member 12 preferably along the fold line of outer flap 20 at the open edge of pocket 24. Loop 34 provides a convenient means for hanging the wrapper 10. In addition, individual wrappers may have different colored ribbons detachably secured to loops so that the ribbons provide a means of identifying the articles therein by means of the color of the ribbons. In addition, a tag 36 may be detachably secured to the loop 34 to provide a further means of identifying the articles.

The flaps and pocket section of flexible member 12 are particularly designed to provide a compact and aesthetically pleasing wrapper 10. FIG. 1 best illustrates the shapes and proportions in a preferred form of wrapper which results in outer flaps 20, 22 completely shielding the edges of inner flaps 16, 18 when in the folded condition. (See FIG. 3.)

As shown in FIG. 1, inner flaps 16, 18 each include a pair of edges 38, 40 which are sloped at a shallow angle from central are 14. The edges 38, 40 are interconnected by a tip portion defined by edges 42, 44 which meet at a point 46. The points 46 are in line with each other along a line which bisects pocket 24. The points 48, 50 are located where the shallow side edges meet the top portion edges.

Pocket 24 is preferably formed by stitching a fabric member to flexible member 12 at the central area 14. As shown in FIG. 1, pocket 24 includes three inner edges 52, 54, 56 with an open side 58 extending from one inner edge 54 to its opposite inner edge 56.

As shown in FIG. 1, points 48, 48 are in line with each other along inner edge 52 of pocket 24 where the edge of base 26 would be located. Similarly points 50, 50 are in line with each other along open face 58. The length of inner flap 16, 18 from its respective inner edge 54 or 56 of pocket 24 to the point 46 would preferably be 0.8 times the length of pocket 24 between inner edges 54, 56.

Outer flaps 20, 22 are of generally triangular shape having edges 60, 62 which converge toward each other from central area 14 and meet at a point 64. The length of each outer flap from its respective edge of pocket 24 to point 64 is 1.2 times the width of pocket 24 (i.e., the distance between edges 52 and 58). Points 64 are in line with each other along a line which bisects pocket 24.

As also shown in FIG. 1, each flap may be considered as starting along an imaginary line 65 formed at a 45° angle from each respective corner of pocket 24 at base 26. Spacing the outer edges of the flaps away from pocket 24 and having the flaps meet along curved edges permits the thickness of wrapper 10 to be adjustable.

Wrapper 10 may be made in various sizes. For example, a set of four different size wrappers might ideally suit a traveller for accommodating all necessary clothing. The different colored ribbons and/or tags would differentiate the type of articles in the individual wrappers, particularly where more than one wrapper of the same size is used.

The following are dimensions for an operative embodiment of wrapper 10. The length of pocket 14 is $17\frac{1}{8}$ inches while the maximum length of inner flaps 16, 18 is 13.7 inches. The width of pocket 14 is $11\frac{1}{4}$ inches and the maximum length of outer flaps 20, 22 is $13\frac{1}{2}$ inches. The outer edge of each flap starts 2 inches away from a respective corner of pocket 14 along a line at an angle of 45° which bisects the right angle of that corner. The distance between "intersection points 48, 50 is about $11\frac{3}{4}$ inches, while tip point 46 extends $2\frac{1}{2}$ inches beyond the line joining points 48, 50 as measured from a line perpendicular to the line joining points 48, 50. Base 28 is about the same size as pocket 24, namely $11\frac{1}{4}$ by $17\frac{1}{8}$ inches, to fit snugly in pocket 24. Shape retainer 28 is made slightly smaller than base 26. Specifically shape retainer 28 is $10\frac{1}{4}$ by $16\frac{1}{8}$ inches. Strips 66, 68, 70, 72 are each 6 inches long.

Although a specific shape and specific dimensions have been described for wrapper 10, it is to be understood that the invention is not limited to those dimensions or shape. For example, flexible member 12 may have smooth curved edges rather than the straight line edges and sharp intersections.

Figure 7:
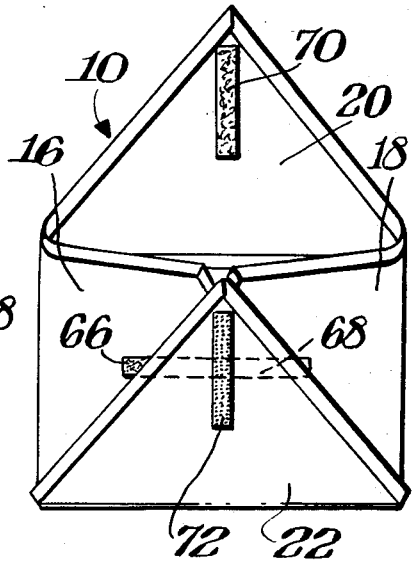
FIG. 7 is a top plan view similar to FIG. 6 showing a further step in the folding of the wrapper.

Any suitable fastening means may be used in accordance with this invention. In a preferred practice the fastening means comprises Velcro strips 66, 68, 70, 72 on the various flaps. As shown in FIGS. 1 and 5, strips 68, 70 would be on the face of flaps 18, 20 on the inner side of flexible member 12 while Velcro strips 66, 72 on flaps 16, 22 would be on the outer side of flexible member 12. In this manner, flap 16 could first be folded as shown in FIG. 6 and flap 18 would then be folded thereover so that the Velcro strips 66, 68 contact each other. Flap 22 would then be folded over flap 18 as shown in FIG. 7 and finally flap 20 would be folded over flap 22 so that Velcro strips 70, 72 contact each other. The provision of pointed tip members enables fastening means such as elongated Velcro strips to be positioned at extreme portions of the flaps and then extend inwardly toward pocket 24 thereby maximizing the degree of adjustability in the thickness of wrapper 12 in its final condition.

In practice, inner flaps 16, 18 completely cover all of the clothing and outer flaps 20, 22 then provide the desired snugness to prevent any movement of the clothing.

As should be apparent, wrapper 10 provides a distinct advancement in the packing of clothing and the like particularly for travelers. The use of shape retainer 28 makes the folding of clothing easier. Moreover, by providing stiffening means or rigid members such as base 26 on one side and shape retainer 28 on the other side of the stack of clothing, the clothing is prevented from wrinkling regardless of the orientation of wrapper 10.

The particular shape of the flaps and the provision of suitable fastening means such as Velcro strips results in an extremely adjustable wrapper capable of handling various amounts of clothing. Wrapper 10 is similarly easy to open and easy to close. Any number of articles of clothing may be conveniently removed or added, and then wrapper 10 could be closed and accommodate the new size stack.

Obviously wrapper 10 would not be limited to articles of clothing which would be folded around shape retainer 28. Other articles of clothing such as socks, handkerchiefs and the like could similarly be wrapped in wrapper 10 provided that in the packing of the articles, the articles are placed in the central area above base 26.

Wrapper 10 provides a means of organizing all articles of clothing in suitcases in a manner easy to find in that articles of the same nature could all be packed in a single wrapper. A set of wrappers could thus be used for numerous types of individual articles which are easily distinguished by the colored loops or identification tags. Preferably the open side 58 of pocket 24 would be along the fold line near loop 34 so that in the normal carrying or hanging condition, the open side 58 would be facing upwards thus minimizing any tendency for base 26 to slide out of pocket 24.

In practice wrapper 10 permits the traveler to easily remove individual articles without affecting other articles in the suitcase where a number of wrappers 10 are in the same suitcase. In addition on either short or long trips there is no need to unpack clothes, while unpacking is easier at the end of a trip because of the organized manner of arranging the articles in the set of wrappers 10. In fact, wrappers 10 provide a convenient means of storing out of season articles where the articles would not be wrinkled, would be protected from dust, would be easily identifiable and readily available.

A further advantage of wrapper 10 is its appearance which would resemble an attache case as shown in FIG. 3 thus providing a convenient manner of carrying individual wrappers 10 into, for example, a hotel. Wrapper 10 could also be inserted into a shoulder bag, and the vertical positioning would not cause any wrinkling to the clothing.

What is claimed is:

1. A wrapper for clothing and the like comprising a flexible member having a central area and a plurality of wing sections extending outwardly from said central area, a rigid reinforcing base having a geometric shape being located in said central area, a rigid shape retainer having the same geometric shape as said base but being of lesser dimension than said base whereby individual articles of clothing or the like may be selectively folded about said shape retainer to be folded to said geometric shape and then the articles may be placed on said base, said shape retainer being capable of being disposed in said folded flexible member generally parallel to and remote from said base to provide a stiffening means on opposite sides of the articles, said wing sections being foldable over said base and said shape retainer with the articles therebetween to envelop the articles within the folded flexible member, said wing sections comprising means for maintaining said base at a fixed location at said central area and for maintaining said shape retainer directly above said base when said wing sections are folded whereby the articles are confined between said base and said shape retainer to maintain the articles in a flat condition, and fastening means for maintaining said flexible member in a folded condition.

2. The wrapper of claim 1 wherein said shape retainer has indicia at the midpoint of at least one edge to act as a centering guide in the folding of said articles thereabout.

3. The wrapper of claim 1 wherein said central area includes a pocket, and said base being insertable into said pocket.

4. The wrapper of claim 3 wherein said fastening means comprises adjustable fastening means on each of said wing sections.

5. The wrapper of claim 4 including a loop secured to said flexible member and disposed on the outside of said flexible member when said flexible member is in its folded condition.

6. The wrapper of claim 5 wherein said pocket has an open side located along a folded edge of one of said wing sections, and said loop being disposed along said folded edge.

7. The wrapper of claim 5 wherein said geometric shape is a rectangle.

8. The wrapper of claim 7 wherein said shape retainer has indicia at the midpoint of at least one edge to act as a centering guide in the folding of said articles thereabout.

9. The wrapper of claim 7 wherein said wing sections include a first pair of oppositely extending inner flaps and a second pair of oppositely extending outer flaps, and each inner flap being located between pairs of outer flaps.

10. The wrapper of claim 9 wherein the edges of said inner flaps are completely shielded by said outer flaps when said flexible member is in its folded condition.

11. The wrapper of claim 10 wherein each of said inner flaps is located adjacent to and extends away from the short edges of said rectangle, and said outer flaps extend away from the intermediate long edges of said rectangle.

12. The wrapper of claim 11 wherein each of said inner flaps includes a pair of edges sloped at a shallow angle and converging outwardly toward each other away from said central area, a tip portion connecting said sloped edges, said tip portion and said sloped edges having points of intersection, and the respective points of intersection of each of said inner flaps being in line with a corresponding point of intersection on the other of said inner flaps and in line with an edge of said pocket.

13. The wrapper of claim 12 wherein each tip portion includes outwardly extending edges which meet at a point, and the tip points of said inner flaps being in line with each other along a line bisecting said pocket.

14. The wrapper of claim 12 wherein the length of each inner flap from said pocket to its tip point is 0.8 times the length of said pocket.

15. The wrapper of claim 14 wherein said fastening means is located on said tip portion of each of said inner flaps and extends toward said pocket to maximize the degree of fastening adjustability.

16. The wrapper of claim 15 wherein each of said outer flaps has edges which converge toward each other away from said pocket.

17. The wrapper of claim 16 wherein said converging edges on each of said outer flaps meet at a point, and said outer flap points being in line with each other along a line bisecting said pocket.

18. The wrapper of claim 17 wherein the length of each of said outer flaps from said pocket to its point is 1.2 times the width of said pocket.

19. The wrapper of claim 18 wherein said fastening means is provided on each of said outer flaps from the general area of each tip toward said pocket to maximize the degree of fastening adjustability.

20. The wrapper of claim 19 wherein each of said flaps starts at a point along an imaginary line radiating from a respective corner of said pocket at an angle of 45°.

21. The wrapper of claim 20 wherein said flexible member is made of fabric to facilitate the bendability and cleanability thereof.

22. The wrapper of claim 11 wherein each of said outer flaps has edges which converge toward each other away from said pocket.

23. The wrapper of claim 22 wherein said converging edges on each of said outer flaps meet at a point, and said outer flap points being in line with each other along a line bisecting said pocket.

24. The wrapper of claim 23 wherein the length of each of said outer flaps from said pocket to its point is 1.2 times the width of said pocket.

25. The wrapper of claim 24 wherein said fastening means is provided on each of said outer flaps from the general area of each tip toward said pocket to maximize the degree of fastening adjustability.

26. The wrapper of claim 4 wherein said geometric shape is a rectangle.

27. The wrapper of claim 26 wherein said wing sections include a first pair of oppositely extending inner flaps and a second pair of oppositely extending outer flaps, and each inner flap being located between pairs of outer flaps.

28. The wrapper of claim 27 wherein the edges of said inner flaps are completely shielded by said outer flaps when said flexible member is in its folded condition.

29. The wrapper of claim 28 wherein each of said inner flaps is located adjacent to and extends away from the short edges of said rectangle, and said outer flaps extend away from the intermediate long edges of said rectangle.

30. The wrapper of claim 29 wherein each of said inner flaps includes a pair of edges sloped at a shallow angle and converging outwardly toward each other away from said central area, a tip portion connecting said sloped edges, said tip portion and said sloped edges having points of intersection, and the respective points of intersection of each of said inner flaps being in line with a corresponding point of intersection on the other of said inner flaps and in line with an edge of said pocket.

31. The wrapper of claim 30 wherein each tip portion includes outwardly extending edges which meet at a point, and the tip points of said inner flaps being in line with each other along a line bisecting said pocket, the length of each inner flap from said pocket to its tip point is 0.8 times the length of said pocket, and said fastening means is located on said tip portion of each of said inner flaps and extends toward said pocket to maximize the degree of fastening adjustability.

32. The wrapper of claim 29 wherein each of said outer flaps has edges which converge toward each other away from said pocket.

33. The wrapper of claim 32 wherein said converging edges on each of said outer flaps meet at a point, and said outer flap points being in line with each other along a line bisecting said pocket, the length of each of said outer flaps from said pocket to its point is 1.2 times the width of said pocket, and said fastening means is provided on each of said outer flaps from the general area of each tip toward said pocket to maximize the degree of fastening adjustability.

34. The wrapper of claim 1 wherein said flexible member is made of fabric to facilitate the bendability and cleanability thereof.

35. A method of wrapping clothing and the like comprising providing a flexible member having a central area and a plurality of wing sections extending outwardly from the central area, locating a rigid reinforcing base in the central area, providing a rigid shape retainer which has the same geometric shape as the base but has a lesser dimension with the shape retainer being unattached to any fixed surface, wrapping an article of clothing or the like around the shape retainer so that the article of clothing or the like is folded to a shape generally conforming to the shape and size of the base, removing the shape retainer from the folded article, placing the folded article on the base, placing the shape retainer on the article directly above the base whereby the article is thereby disposed between the rigid base and rigid shape retainer, folding the wing sections over the base and article and shape retainer to envelop the article within the folded flexible member, confining the base at a fixed location at the central area and confining the shape retainer directly above the base with the article therebetween by means of the wing sections folding step, and fastening the wing sections together by manipulating adjustable fasteners which are capable of securing the wing sections together over a range of dimensions in accordance with the spacing of the shape retainer from the base to maintain the flexible member in a folded condition.

36. The method of claim 35 including providing a pocket in the central area, inserting the base into the pocket, selectively folding a plurality of individual articles of clothing one at a time around the shape retainer, placing each article on the base to provide a stack of articles, and placing the shape retainer on the outermost article of the stack before the wing sections are folded.

37. The method of claim 36 including unfastening and unfolding the wing sections, removing an article from the stack, and re-folding and re-fastening the wing sections.

* * * * *